US007852360B2

(12) United States Patent
Takahashi

(10) Patent No.: US 7,852,360 B2
(45) Date of Patent: Dec. 14, 2010

(54) THERMAL PRINTER UNIT AND PRINTING DEVICE

(75) Inventor: Masanori Takahashi, Chiba (JP)

(73) Assignee: Seiko Instruments Inc. (JP)

( * ) Notice: Subject to any disclaimer, the term of this patent is extended or adjusted under 35 U.S.C. 154(b) by 241 days.

(21) Appl. No.: 12/286,866

(22) Filed: Oct. 2, 2008

(65) Prior Publication Data

US 2010/0020154 A1 Jan. 28, 2010

(30) Foreign Application Priority Data

Oct. 4, 2007 (JP) ..... 2007-261105

(51) Int. Cl.
*B41J 25/308* (2006.01)

(52) U.S. Cl. ..... 347/198

(58) Field of Classification Search ..... 347/197, 347/198; 400/120.16, 120.17
See application file for complete search history.

(56) References Cited

U.S. PATENT DOCUMENTS 6,249,302 B1 * 6/2001 Sekiya ..... 347/220
2002/0080223 A1 6/2002 Connor ..... 347/198
2006/0082636 A1 4/2006 Maruyama ..... 347/197
2007/0212142 A1 9/2007 Zevin et al. ..... 400/56

FOREIGN PATENT DOCUMENTS

| | | |
|---|---|---|
| DE | 19527610 | 1/1997 |
| EP | 1498276 | 1/2005 |
| WO | 2005001667 | 6/2005 |

* cited by examiner

*Primary Examiner*—Huan H Tran
(74) *Attorney, Agent, or Firm*—Adams & Wilks

(57) ABSTRACT

In order to realize an adjustment mechanism which can adjust the pressing force of a thermal head according to paper thickness, and in addition, which is suitable for a small thermal printer, in a small thermal printer in which a platen roller (11) is adapted to be detachably attachable to arms for rotatably holding the platen roller and room at the back of a thermal head where a spring (16) for pressing the thermal head (14) toward the platen roller is disposed is narrow, an auxiliary plate for receiving the spring is provided at the back of the thermal head, the auxiliary plate (13) is adapted to be approachable to or separable from a head support plate (15), and means (18, 41) which can adjust a position of the auxiliary plate with respect to a position of the head support plate (15) is provided.

6 Claims, 3 Drawing Sheets

THERMAL PRINTER UNIT AND PRINTING DEVICE

BACKGROUND OF THE INVENTION

1. Field of the Invention

The present invention relates to a technique which is effective when used in a printing device, and further, a printing device (printer) with a printhead being in pressure contact with a platen roller and with a printing paper sheet sandwiched between the printhead and the platen roller for conducting printing. More particularly, the present invention relates to a thermal printing device (thermal printer) which can conduct satisfactory printing on printing paper sheets of different thicknesses.

2. Description of the Related Art

In a thermal printer which conducts printing with roll thermal paper (hereinafter referred to as roll paper) inserted in between a printhead having a heater element (hereinafter referred to as a thermal head) and a platen roller, because the thermal head is in pressure contact with the platen roller, when the roll paper is loaded, it is necessary to release the thermal head from the platen roller and to insert a leading edge of new roll paper thereinbetween.

For example, Patent Document 1 (JP 2003-251837 A) and Patent Document 2 (JP 2006-116714 A) disclose a conventional technique for making it easier to insert roll paper in between a thermal head and a platen roller when the roll paper is loaded. In these patents, a cam is disposed at the back of the thermal head. The cam is adapted to be rotated to, against repulsion of a spring, press the thermal head against the platen roller. The cam is also adapted to be rotated in an opposite direction to move, using the repulsion of the spring, the thermal head away from the platen roller to create clearance therebetween into which roll paper is to be inserted.

Further, as a technique for making it easier to set roll paper between a thermal head and a platen roller, there is a clam shell printer disclosed in, for example, Patent Document 3 (JP 2000-318260 A) in which the platen roller is detachable.

In order to conduct correct printing by a thermal printer, it is necessary to press a thermal head against a platen roller and to position a heater element of the thermal head in a range where a surface of the platen roller made of rubber becomes flat (which is called a nip). Various kinds of thermal paper for printing are offered in the market, and it is required to conduct high quality printing on any kind of thermal paper.

However, if the thickness of the thermal paper varies and still the thermal head is pressed against the platen roller with the same pressure, there is a possibility that the width of the nip varies and the quality of the printing is lowered. More specifically, as the thickness of the thermal paper becomes larger and the thermal paper becomes sturdy, the width of the nip becomes smaller, and thus, it is desirable that the pressing force of the thermal head be made to be larger as the thickness of the thermal paper becomes larger. However, in a conventional thermal printer, because a function of changing the pressing force of the thermal head is not provided, there is an inconvenience that the quality of the printing varies depending on the paper thickness.

A problem of the structures disclosed in Patent Documents 1 and 2 that paper is difficult to insert is solved in the clam shell as disclosed in Patent Document 3. FIG. 6 illustrates a conventional structure of a unit used in a clam shell printer. In this unit, hemispherical bearing concave portions 12*a* and 12*b* with which a shaft of a platen roller 11 can be engaged is formed at tips of arms 12A and 12B of a holder 12 for holding a head support plate 15 having a thermal head 14. The shaft of the platen roller 11 is adapted to be detachably engaged with the bearing concave portions 12*a* and 12*b*. A clam shell printer with such a unit also does not have a pressure changing mechanism as described in the present application, and, pressure necessary for thick paper is applied such that all recommended paper sheets can be used without the need for adjustment. However, the high pressure means that torque transferred by a motor becomes larger, and power consumption of and heat generated by the motor are bad. Also, because load applied to a gear which transfers power becomes heavier, the durability of the gear is decreased. Therefore, it is revealed that to accommodate both thin paper and thick paper with only one model forces a customer who only uses thin paper to put up with a lower specification due to a useless function, and, on the other hand, to set an additional model which accommodates thick paper is not preferable from the viewpoint of inventory control.

Accordingly, the present inventors studied making adjustable the pressing force of the thermal head according to the paper thickness. In the inventions described in Patent Document 1 and Patent Document 2 described above, a cam is disposed at the back of the thermal head, and the pressing force is adapted to be applied to the thermal head using a repulsion of a leaf spring brought in contact with the cam or of a compression spring inserted between a plate brought in contact with the cam and the thermal head. By using such a cam, it is also possible to change the pressing force of the thermal head.

However, a thermal printer to which the inventions described in Patent Document 1 and Patent Document 2 are applied is relatively large, and thus, there is room to dispose the cam at the back of the thermal head. On the other hand, in a small thermal printer which the present inventors regard as the target, there is not enough room at the back of the thermal head and it is difficult to dispose the cam. Therefore, if a cam is used to change the pressing force of the thermal head, there is a problem that the apparatus becomes large.

Further, because, in the printers described in Patent Document 1 and Patent Document 2, the position of the platen roller is not movable with respect to the position of a member for rotatably holding the platen roller, it is necessary to keep enough distance between the platen roller and the thermal head when roll paper is loaded, and thus, the cam is used to move the thermal head a relatively large distance. Therefore, when the thermal head is moved by means other than the cam (for example, a feed screw), there are inconveniences that it takes much time to move the thermal head and the number of parts is increased.

Further, in the printers described in Patent Document 1 and Patent Document 2, it is also possible that the cam for making it easier to load roll paper is adapted to be used to change the pressing force of the thermal head, but it is revealed that, if such a structure is adopted, because it is necessary to adjust the position of the cam every time a user loads roll paper such that optimum pressure can be obtained according to the thickness of the paper to be used, not only the setting is burdensome but also inappropriate pressure may be set by accident.

SUMMARY OF THE INVENTION

It is an object of the present invention to provide an adjustment mechanism which can adjust the pressing force of a thermal head according to paper thickness, and in addition, which is suitable for a small thermal printer.

Another object of the present invention is to provide a thermal printer in which the pressing force of a thermal head can be adjusted according to paper thickness, in which it is not necessary to adjust the pressing force of the thermal head every time when the same kind of printing paper sheets are used, which provides ease of use, and in which erroneous setting is less liable to occur.

In order to attain the above objects, according to the present invention, in a small thermal printer in which a platen roller is adapted to be detachably attachable to arms for rotatably holding the platen roller and room at the back of a thermal head where a spring for pressing the thermal head toward the platen roller is disposed is narrow, an auxiliary plate for receiving the spring is provided at the back of the thermal head, the auxiliary plate is adapted to be approachable to or separable from a head support plate, and means which can adjust a position of the auxiliary plate with respect to a position of the head support plate is provided.

More specifically, a thermal head having a heater element, a head support plate for holding the thermal head, a holder having a pair of arm portions for rotatably holding the head support plate and a plate portion for connecting respective one ends of the arm portions, a platen roller engaged with concave portions formed in part of the arm portions and disposed so as to be in proximity to the head support plate, an auxiliary plate rotatably provided between the plate portion of the holder and the head support plate, a spring inserted between the auxiliary plate and the head support plate, and adjustment means which can adjust a position of the auxiliary plate with respect to a position of the head support plate are provided. Here, the adjustment means may be, for example, a spacer which can be inserted between the plate portion and the auxiliary plate, or a screw which is inserted into a screw hole provided in the plate portion and a tip of which is adapted to be in contact with the auxiliary plate.

According to the above-mentioned means, because the repulsion of the spring, and hence, the pressing force of the thermal head against the platen roller can be changed by adjusting the position of the auxiliary plate with respect to the position of the head support plate, satisfactory printing can be conducted by changing the pressing force of the thermal head according to the thickness of the printing paper sheet to be used. Therefore, a user is not required to prepare different printers according to the kind of the printing paper sheet to be used, and one printer can accommodate various kinds of printing paper sheets. Further, a manufacturer can prepare and provide with ease a printer in which the pressing force of the thermal head is optimally set according to the kind of a printing paper sheet to be used by a user.

It is to be noted that, a printer which is provided at present can also be adapted to accommodate various kinds of printing paper sheets by pressurizing the platen with pressure which is higher than necessary, but, if such is done when the purpose is to use only thin paper, the lifetime of the printer is shortened wastefully. In a printer according to the present invention, because pressure which is optimum for the specifications of paper which a user wants to use can be applied, there is an advantage that, while necessary print quality is maintained, the printer lifetime can be set to be appropriate for the paper.

Further, when a spacer is used as the adjustment means, it is desirable that a step portion be formed in the plate portion, and the position of the auxiliary plate with respect to the position of the head support plate is adapted to be changed by inserting the spacer between an area where the step portion exists and the auxiliary plate or between an area where the step portion does not exist and the auxiliary plate. This can change the pressing force of the thermal head against the platen roller with a relatively simple structure and with ease.

Further, when a spacer is used as the adjustment means, it is desirable that a protrusion be provided on the auxiliary plate or the spacer and a positioning hole with which the protrusion can be engaged be provided in the spacer or the auxiliary plate. This can prevent the inserted spacer from being displaced.

According to the present invention, an adjustment mechanism which can adjust the pressing force of the thermal head according to paper thickness, and in addition, which is suitable for a small thermal printer can be materialized. Further, there is an effect that a thermal printer can be materialized in which the pressing force of the thermal head can be adjusted according to paper thickness, which can thus improve the print quality and can make longer the lifetime of the printer, in which it is not necessary to adjust the pressing force of the thermal head every time when the same kind of printing paper sheets are used, which provides ease of use, and in which erroneous setting is less liable to occur.

DETAILED DESCRIPTION OF THE PREFERRED EMBODIMENT

In the following, preferred embodiments of the present invention are described based on drawings.

Figure 1:
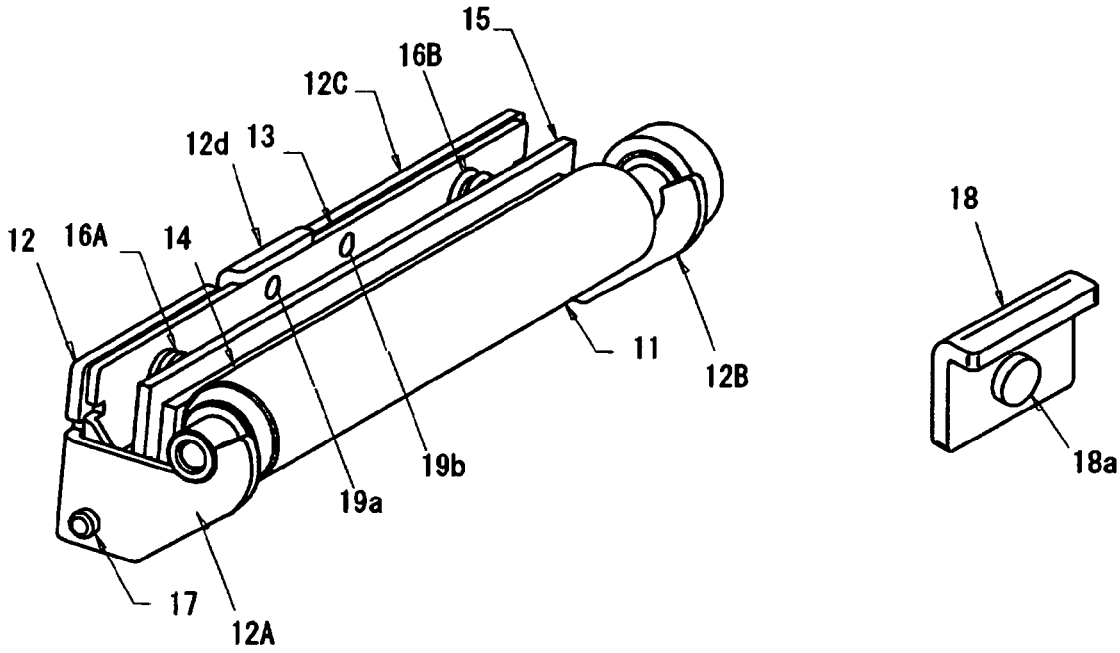
FIG. 1 is a perspective view illustrating a first embodiment of a printer unit to which the present invention is applied.

FIG. 1 illustrates a first embodiment of a printer unit to which the present invention is applied. The printer unit according to this embodiment is formed of a platen roller 11, a holder 12 having arms 12A and 12B on both sides thereof for holding a shaft of the platen roller 11, an auxiliary plate 13 disposed between a plate portion 12C of the holder 12 and the platen roller 11, a head support plate 15 with a thermal head 14 held on a front surface thereof, a pair of compression springs 16A and 16B inserted between the auxiliary plate 13 and a rear surface of the head support plate 15, and the like.

Semicircular bearing concave portions 12*a* and 12*b* with which the shaft of the platen roller 11 can be engaged are formed at tips of the arms 12A and 12B of the holder 12. By holding with the two arms 12A and 12B the shaft of the platen roller 11 engaged with the bearing concave portions 12*a* and 12*b*, the platen roller 11 is rotatably supported. Although not shown in the figure, a plurality of heater elements are provided in a line in a direction in parallel with the shaft in an area of a front surface of the thermal head 14 which is in contact with the platen roller 11.

The auxiliary plate 13 and the head support plate 15 are rotatably attached to a rotation spindle 17 which bridges over base portions of the arms 12A and 12B, respectively. When the compression springs 16A and 16B are inserted therebetween, a rear surface of the auxiliary plate 13 is brought into contact with a front surface of the plate portion 12C of the holder 12 to be pressed by the springs. Then, the front surface of the thermal head 14 is adapted to be pressed toward the platen roller 11 by the head support plate 15 on a side opposite to the compression springs 16A and 16B which is pressed forward by the repulsion of the springs. Although not shown in the figure, a gear is fixedly attached to another end of the platen roller 11, and rotational force is transferred from a drive motor (not shown) via a gear transfer mechanism to rotate the platen roller 11 according to printing by the thermal head 14.

The printer unit according to the first embodiment is adapted to change the pressing force of the thermal head 14 against the platen roller 11 by inserting a spacer 18 between the auxiliary plate 13 and the plate portion 12C of the holder 12 thereby to change the distance between the auxiliary plate 13 and the head support plate 15 and to change the magnitude of the repulsion of the compression springs 16A and 16B.

Further, in order to change the distance between the auxiliary plate 13 and the head support plate 15 using the same spacer 18, a step portion formed of a bent piece 12*d* is formed substantially at the center of the plate portion 12C of the holder 12. Further, in order to prevent sideways displacement of the spacer 18 inserted between the auxiliary plate 13 and the plate portion 12C of the holder 12, a cylindrical protrusion 18*a* is formed on a front surface of the spacer 18, while positioning holes 19*a* and 19*b* which can engage with the protrusion 18*a* are formed in the plate portion 12C. One of the positioning holes 19*a* and 19*b* (19*a*) is provided at a position corresponding to the bent piece 12*d* and the other (19*b*) is provided in an area which does not have the bent piece 12*d*.

Figure 2:
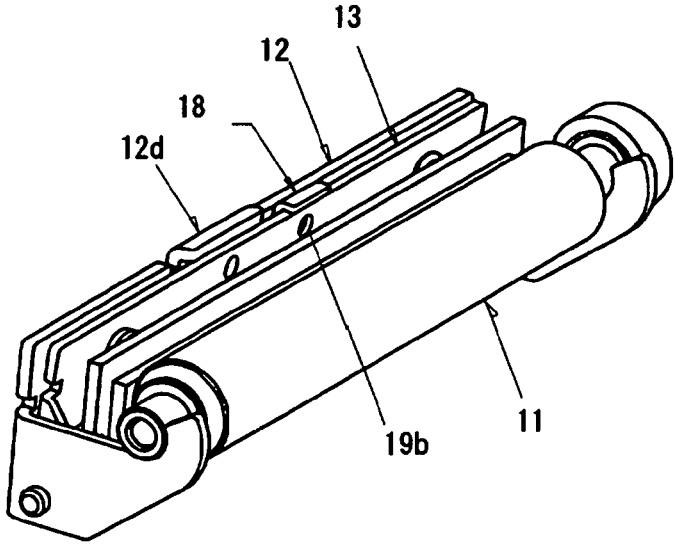
FIG. 2 is a perspective view of the printer unit according to the first embodiment illustrating a state where a spacer is inserted between a plate portion of a holder and an auxiliary plate.

In this embodiment, when the spacer 18 is inserted between the plate portion 12C of the holder 12 and the auxiliary plate 13 at a position where the protrusion 18*a* is engaged with the positioning hole 19*b*, as illustrated in FIG. 2, the distance between the auxiliary plate 13 and the head support plate 15 is made smaller by the thickness of the spacer 18 compared with that illustrated in FIG. 1 to make larger the repulsion of the compression springs 16A and 16B by one increment.

Figure 3:
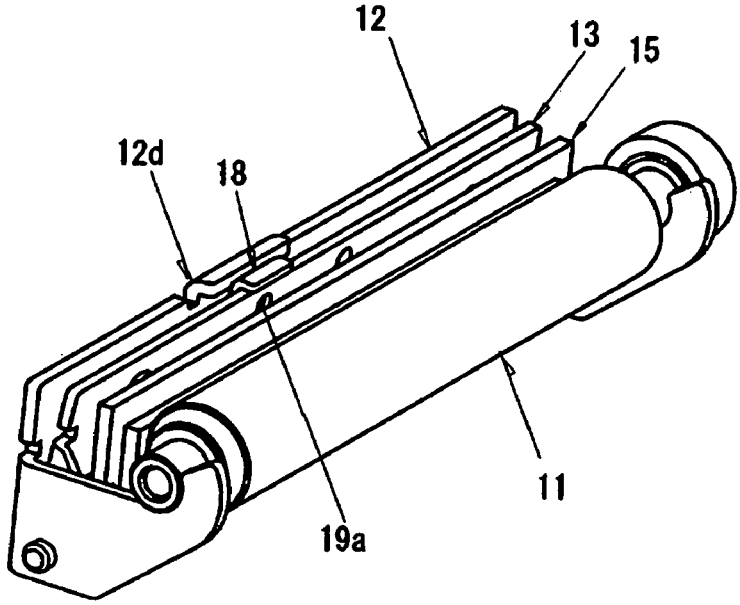
FIG. 3 is a perspective view of the printer unit according to the first embodiment illustrating a state where the spacer is inserted between the plate portion and the auxiliary plate at a step portion of the holder.

Further, when the spacer 18 is inserted between the plate portion 12C of the holder 12 and the auxiliary plate 13 at a position where the protrusion 18*a* is engaged with the positioning hole 19*a*, as illustrated in FIG. 3, the distance between the auxiliary plate 13 and the head support plate 15 is made smaller by the thickness of the spacer 18 plus the step of the bent piece 12*d* compared with that illustrated in FIG. 1 to make larger the repulsion of the compression springs 16A and 16B by two increments.

Accordingly, when printing is conducted on thin paper, as illustrated in FIG. 1, the spacer 18 is not inserted, while, when printing is conducted on thick paper, as illustrated in FIG. 3, the spacer 18 is inserted at the position corresponding to the bent piece 12*d*. Further, when printing is conducted on paper having an intermediate thickness, as illustrated in FIG. 2, the spacer 18 is inserted at a position which does not have the bent piece 12*d*. This makes it possible to press the thermal head 14 against the platen roller 11 with optimum force according to the paper thickness to conduct satisfactory printing. It is to be noted that the relationship between the protrusion 18*a* and the positioning holes 19*a* and 19*b* may be opposite. More specifically, the positioning holes 19*a* and 19*b* may be provided in the spacer 18 and the protrusion may be provided on the plate portion 12C of the holder 12.

Further, because, in the printer unit according to this embodiment, the platen roller 11 is detachably attached to the tips of the arms 12A and 12B of the holder 12, printing paper sheet is adapted to be loaded by removing the platen roller 11, pulling out the printing paper sheet at a leading edge thereof, positioning a predetermined area of the paper on the side of the front surface of the thermal head 14, and then engaging the platen roller 11 again with the concave portions at the tips of the arms 12A and 12B. Therefore, even in a small thermal printer where, for example, the length of the platen roller 11 is 5 to 6 cm or smaller, the dimension of the room at the back of the thermal head 14 is 1 cm or smaller, and it is extremely difficult to load printing paper sheet by making larger the distance between the platen roller 11 and the thermal head 14 and inserting a leading edge of the printing paper sheet, printing paper sheet can be loaded with ease.

Figure 4:
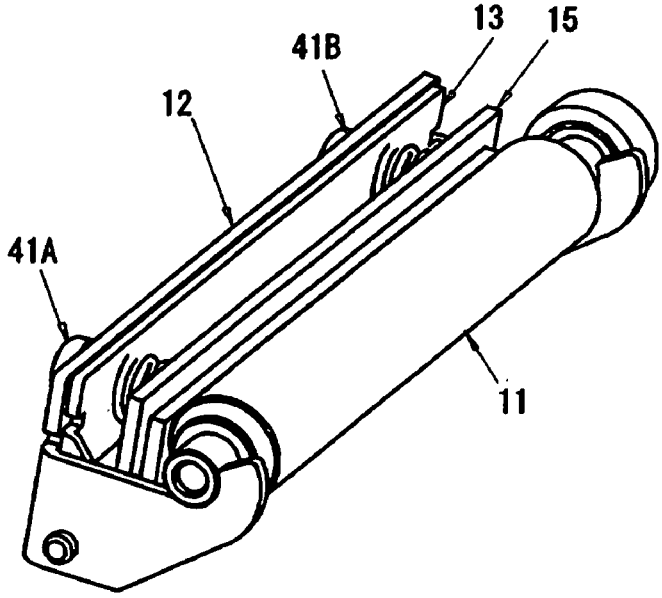
FIG. 4 is a perspective view illustrating a second embodiment of the printer unit to which the present invention is applied.

FIG. 4 illustrates a second embodiment of the printer unit to which the present invention is applied. The printer unit according to this embodiment is adapted to change the pressing force of the thermal head 14 by providing screw holes for inserting adjustment screws 41A and 41B thereinto in the plate portion 12C of the holder 12 having the arms 12A and 12B for holding the shaft of the platen roller 11, bringing tips of the adjustment screws inserted into the screw holes into contact with the rear surface of the auxiliary plate 13 disposed between the plate portion 12C and the platen roller 11, screwing the screws, and thus, changing the distance between the auxiliary plate 13 and the head support plate 15 thereby adjusting the repulsion of the compression springs 16*a* and 16*b*.

It is desirable that the above-mentioned adjustment screws 41A and 41B have scales in the vicinity thereof such that the amounts of adjustment of the left and right screws can be set to be the same. The printer unit according to this embodiment has an advantage that the pressing force of the thermal head 14 can be changed in an analog way.

Figure 5:
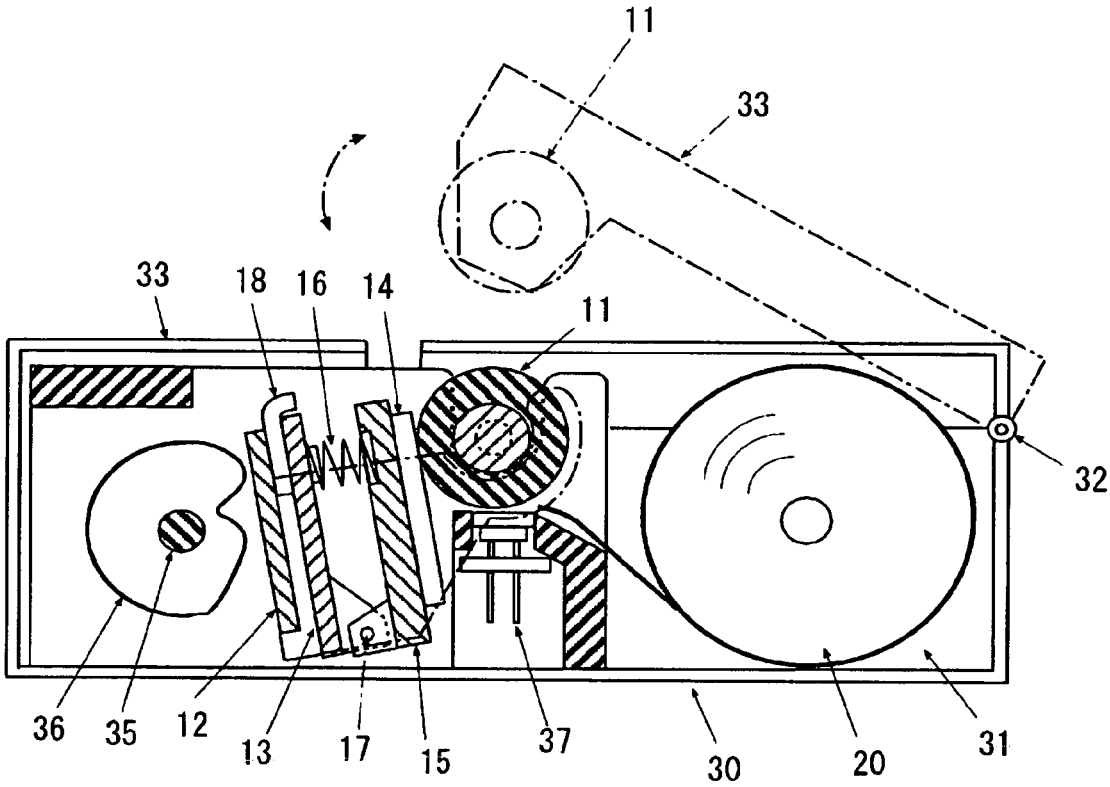
FIG. 5 is a sectional side view illustrating an exemplary structure of a preferred printer using the printer unit according to the embodiment.
Figure 6:
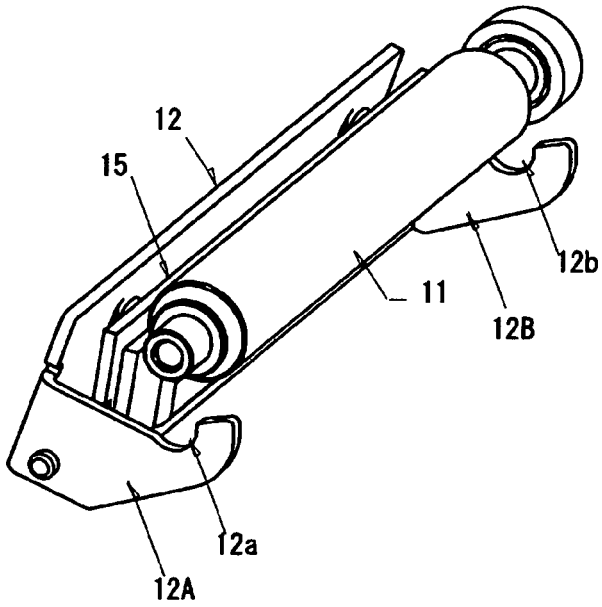
FIG. 6 PRIOR ART
FIG. 6 is a perspective view illustrating an exemplary structure of a printer unit used in a conventional clam shell printer.

FIG. 5 illustrates an exemplary structure of a preferred printer using the printer unit according to the above-mentioned embodiment.

The printer illustrated in FIG. 5 is provided with the printer unit illustrated in FIG. 1, a printer frame body 30 having a housing portion 31 for housing roll paper 20 which is thermal paper wound into a roll, and a cover 33 rotatably attached to one end of the printer frame body 30 about a spindle 32. The platen roller 11 forming the printer unit is rotatably attached to a distal end side of the cover 33. Reference numeral 37 denotes a sensor for detecting paper.

Further, a cam 36 fixedly attached to a shaft 35 is provided at the back of the plate portion 12C of the holder 12. By rotating a lever (not shown) provided at an end of the camshaft 35, the cam 36 is rotated and the plate portion 12C is rotated forward, whereby the shaft of the platen roller 11 and the arms 12A and 12B of the holder 12 are adapted to move out of engagement. Further, in front portions of side walls of the printer frame body 30, at positions overlapping with the concave portions 12*a* and 12*b* of the arms 12A and 12B of the holder 12, similar concave portions are formed, whereby the shaft of the platen roller 11 is engaged with the concave portions. Normally, the concave portions in the side walls of the printer frame body 30 and the concave portions 12*a* and 12*b* of the arms 12A and 12B hold the shaft of the platen roller 11 so as not to pop up.

Therefore, when, after the cam 36 is rotated to move the shaft of the platen roller 11 and the arms 12A and 12B of the holder 12 out of engagement, the cover 33 is rotated upward as illustrated by alternate long and short dashed lines in FIG. 5, an upper portion of the printer is wide open. With this state maintained, the roll paper 20 is put in the housing portion 31, and a leading edge of the roll paper is pulled out to reach in front of the thermal head 14 of the printer unit. After that, the cover 33 is rotated in an opposite direction such that the shaft of the platen roller 11 at the distal end thereof is pressed in and engaged with the arms 12A and 12B and with the concave portions in the side walls of the frame body 30. Then, the leading edge of the roll paper is sandwiched between the thermal head 14 and the platen roller 11 and is in a state where printing can be conducted.

Further, by, for example, attaching to the spindle 32 of the cover 33 a coil spring for urging at all times the cover in an opening direction, a structure can be obtained where, when the operation lever of the camshaft 35 is operated to move the platen roller 11 out of engagement with the concave portions 12*a* and 12*b* of the arms 12A and 12B, the cover 33 automatically opens and the platen roller 11 is removed with a single motion. Further, it is also possible to, for example, provide an operation lever which protrudes outside the unit at an end portion of the head support plate 15 having the thermal head 14 such that the platen roller 11 is adapted to be removed by moving the head support plate 15 to the side of the auxiliary plate against the spring. In this case, it is not necessary to provide the cam 36.

It is to be noted that, in a printer having the cam 36 as illustrated in FIG. 5, it seems possible to use this cam to change the pressing force of the head, but, because it is the holder 12 that the cam 36 presses, if the holder 12 is moved forward in order to make larger the pressing force of the head, there is an inconvenience that the arm 12A and 12B are rotated and the shaft of the platen roller 11 is liable to be removed. Therefore, in order to make larger the pressing force of the head with the cam while avoiding such an inconvenience, it is necessary to insert the cam between the plate portion 12C of the holder 12 and the auxiliary plate 13, but, as described in the above, because there is no room for inserting the cam in a small printer unit which is the target of the present invention, it is difficult to use the cam.

Although the invention made by the present inventors is specifically described in the above based on the embodiments, it goes without saying that the present invention is not limited to the above embodiments and various modifications can be made within the scope not departing from the gist of the present invention. For example, although, in the first embodiment, a structure where the pressing force of the thermal head 14 can be changed in three steps is described, a structure where the pressing force can be changed in four or more steps by providing a plurality of bent pieces having different step heights is also possible. Further, the steps may be formed not only by the bent piece(s) provided at an upper end of the holder but also on the front surface of the plate portion 12C.

Further, the structure may be such that a plurality of spacers of different thicknesses are prepared and the pressing force is adjusted by changing the spacer to be inserted, or such that a portion tapered in a direction in parallel with the shaft is formed in the step and in the spacer and the pressing force can be adjusted steplessly. Further, although, in the second embodiment, two adjustment screws are used, the screw may be only one. Further, a leaf spring may be used instead of the compression springs 16*a* and 16*b*.

Although examples where the invention made by the present inventors is applied to a thermal printer which is the field as the background of the invention are described in the above, the present invention is not limited thereto. The present invention can also be used when, for example, in a transfer device for transferring paper sandwiched between two rollers, the pressure of the rollers is required to be changed according to the paper thickness.

What is claimed is:

1. A thermal printer unit, comprising:

a thermal head having a heater element;

a head support plate for supporting the thermal head;

a holder having a pair of arm portions for rotatably holding the head support plate and a plate portion for connecting respective one ends of the arm portions;

a platen roller engaged with concave portions formed in part of the arm portions and disposed so as to be in pressure contact with the thermal head;

an auxiliary plate rotatably provided between the plate portion of the holder and the head support plate;

a spring inserted between the auxiliary plate and the head support plate; and adjustment means which can adjust a position of the auxiliary plate with respect to a position of the head support plate.

2. A thermal printer unit according to claim 1, wherein the adjustment means is a spacer which can be inserted between the plate portion and the auxiliary plate.

3. A thermal printer unit according to claim 2, further comprising a step portion formed in the plate portion, wherein the position of the auxiliary plate with respect to the position of the head support plate is changed by inserting the spacer between an area where the step portion exists and the auxiliary plate or between an area where the step portion does not exist and the auxiliary plate.

4. A thermal printer unit according to claim 2, further comprising a protrusion provided on the auxiliary plate or the spacer and a positioning hole provided in the spacer or the auxiliary plate, wherein the protrusion can be engaged with the positioning hole.

5. A thermal printer unit according to claim 1, wherein the adjustment means comprises a screw hole provided in the plate portion and a screw which is inserted into the screw hole and a tip of which is adapted to be in contact with the auxiliary plate.

6. A printing device, comprising:

the thermal printer unit according to claims 1;

a body frame having a first housing portion and a second housing portion, the first housing portion for housing the thermal printer unit and a second housing portion for housing a roll printing paper sheet; and a cover member one end of which is rotatably attached to the body frame and another end of which rotatably holds the platen roller forming the thermal printer unit.

* * * * *